US009691203B1

(12) United States Patent
Shen

(10) Patent No.: US 9,691,203 B1
(45) Date of Patent: Jun. 27, 2017

(54) DOOR ACCESS CONTROL SYSTEM PERMITTING ELECTRONIC AND MECHANICAL UNLOCKING

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days.

(21) Appl. No.: 15/201,670

(22) Filed: Jul. 5, 2016

(30) Foreign Application Priority Data

May 27, 2016 (TW) ..... 105116567 A

(51) Int. Cl.
*E05B 47/02* (2006.01)
*G07C 9/00* (2006.01)

(52) U.S. Cl.
CPC ..... *G07C 9/00126* (2013.01)

(58) Field of Classification Search
CPC ..... G07C 9/00126; G07C 9/00103; G07C 2209/08; E05B 47/0001
See application file for complete search history.

(56) References Cited

U.S. PATENT DOCUMENTS 4,833,465 A * 5/1989 Abend ..... E05B 47/0012 292/144
6,418,763 B1 * 7/2002 Huang ..... E05B 47/0012 292/144
2004/0025550 A1 * 2/2004 Yamagishi ..... G07C 9/00563 70/278.1

* cited by examiner

*Primary Examiner* — Nabil Syed
(74) *Attorney, Agent, or Firm* — Alan D. Kamrath; Kamrath IP Lawfirm, P.A.

(57) ABSTRACT

A door access control system permitting electronic and mechanical unlocking includes a lock mounted to a door and an unlocking device matched with the lock. The lock can be set to be in a normal mode or an away mode. The unlocking device can be used to input a real-time unlocking identification information that is transmitted to the lock for comparison purposes. The lock can also be unlocked by a key. When the lock is set to be in the away mode, an alarm device is activated if the key is used. In this case, a first input device of the lock can be used to input a real-time alarm deactivating information to deactivate the alarm device. When the lock is set to be in the normal mode, the alarm device does not operate even if the key is used to unlock the lock.

18 Claims, 5 Drawing Sheets

DOOR ACCESS CONTROL SYSTEM PERMITTING ELECTRONIC AND MECHANICAL UNLOCKING

BACKGROUND OF THE INVENTION

The present invention relates to a door access control system permitting electronic and mechanical unlocking and, more particularly, to a door access control system permitting a locking state of a door lock to be released by electronic or mechanical unlocking and capable of causing the door lock to generate an alarm message if the locking state of the door lock is released by mechanical unlocking only.

There are various door locks available on the market, including mechanical door locks and electronic door locks using motors, electromagnetic valves, and electronic parts. These door locks can be locked or unlocked independently. A door in a closed position can be locked by a door lock to prevent the door from being opened, achieving an anti-burglar effect.

An electronic door lock can be unlocked remotely by using an electronic unlocking device, such as a remote control, a tablet computer, or a mobile phone. However, the electronic door lock cannot be unlocked if the electronic unlocking device is out of power. In an approach to solve this disadvantage, a mechanical unlocking mechanism is added to an electronic door lock at the cost of significant reduction in the anti-burglar effect, because an electronic door lock is more difficult to be compromised than a mechanical one. Namely, an electronic door lock incorporating a mechanical unlocking mechanism is more vulnerable due to the mechanical unlocking mechanism.

Thus, a need exists for a novel electronic door lock to mitigate and/or obviate the above disadvantages.

BRIEF SUMMARY OF THE INVENTION

In a first aspect, a door access control system includes a lock control unit and an electric setting device electrically connected to the lock control unit. A locking mechanism is electrically connected to the electric setting device. The electric setting device is operable to set the locking mechanism to be in a locking state or an unlocked state. A latch driving device is connected to the locking mechanism. A latch is operatively connected to the latch driving device. The latch driving device is configured to move the latch between a latching position and an unlatching position. When the locking mechanism is set to be in the locked state, the locking mechanism is not permitted to move the latch from the latching position to the unlatching position. When the locking mechanism is set to be in the unlocked state, the locking mechanism is permitted to move the latch from the latching position to the unlatching position. A manual setting device is connected to the locking mechanism. The manual setting device is configured to set the locking mechanism to be in the locking state or the unlocked state. A first input device is electrically connected to the lock control unit. The first input device is operable to input a real-time alarm deactivating information to the lock control unit. A main memory is electrically connected to the lock control unit. A log-in alarm deactivating information and a log-in unlocking identification information are stored in the main memory. A first transmission module is electrically connected to the lock control unit. An alarm device is electrically connected to the lock control unit. The lock control unit is operable not to activate the alarm device or to activate the alarm device to generate an alarm message. A second transmission module is electrically connected to a control module. The first and second transmission modules are connectable to each other. A second input device is electrically connected to the control module. The second input device is operable to input a real-time unlocking identification information. A power supply unit is electrically connected to the control module. The power supply unit is adapted to supply electricity to the control module for operation. A key is electively coupled to the manual setting device.

When the second input device is located within a communication range of the first transmission module, the second input device is permitted to input a real-time unlocking information identification information to the lock control unit.

When the second input device is located outside of a communication range of the first transmission module, the second input device is not permitted to input the real-time unlocking information identification information to the lock control unit.

When the real-time unlocking information identification is not received by the lock control unit, the lock control unit actuates the electric setting device to set the locking mechanism to be in the locking state.

When the real-time unlocking information identification is received by the lock control unit and the log-in unlocking identification information matches with the real-time unlocking identification information, the lock control unit actuates the electric setting device to set the locking mechanism to be in the unlocked state, and the alarm device is inoperative.

When the real-time unlocking information identification is received by the lock control unit and the log-in unlocking identification information does not match with the real-time unlocking identification information, the lock control unit actuates the electric setting device to set the locking mechanism to be in the locking state, and the alarm device is permitted to operate.

When the key is coupled with the manual setting device, the key is permitted to actuate the manual setting device to set the locking mechanism to be in the locking state or the unlocked state. When the key disengages from the manual setting device, the locking mechanism remains in the locking state.

When the manual setting device is used to set the locking mechanism to be in the unlocked state, the lock control unit activates the alarm device to generate the alarm message.

When the alarm device is in operation, the alarm device remains operative until the real-time alarm deactivating information is inputted through the first input device.

When the alarm device is in operation and the real-time alarm deactivating information is inputted through the first input device, the lock control unit stops operation of the alarm device if the log-in alarm deactivating information in the main memory matches with the real-time alarm deactivating information, and the alarm device remains operative if the log-in alarm deactivating information in the main memory does not match with the real-time alarm deactivating information.

In an example, the door access control system further includes a setting module electrically connected to the control module. The setting module is operable to set the lock control unit to be in a normal mode or an away mode. When the lock control unit is set to be in the away mode, the alarm device is permitted to operate. When the lock control unit is set to be in the normal mode, the alarm device is inoperative.

In another example, the door access control system further includes a setting module electrically connected to the lock control unit. The setting module is operable to set the lock control unit to be in a normal mode or an away mode. When the lock control unit is set to be in the away mode, the alarm device is permitted to operate. When the lock control unit is set to be in the normal mode, the alarm device is inoperative.

In a further example, the door access control system further includes a door having an inner side and an outer side opposite to the inner side. The manual setting device and the first input device are mounted to the outer side of the door, and the setting module is located at an inner side of the door. When the latch is in the latching position, the door is not permitted to move from a closed position to an open position. When the latch is in the unlatching position, the door is permitted to move from the closed position to the open position.

In still another example, the door access control system further includes a reporting module electrically connected to the lock control unit. When the alarm device is in an inoperative state, the reporting module does not operate. When the alarm device is in an operative state, the reporting module reports to at least one of police, a security company, and a manager of the lock.

In yet another example, the door access control system further includes a memory electrically connected to the control module. A hardware identification information of the control module is stored in the memory. An identification information log-in device is electrically connected to the lock control unit. A log-in hardware identification information is stored in the main memory. When the identification information log-in device is not used, the lock control unit does not read the hardware identification information in the memory. When the identification information log-in device is used to input an unlocking identification information, the lock control unit reads the hardware identification information in the memory. If the hardware identification information matches with the log-in hardware identification information, the unlocking identification information inputted through the identification information log-in device is stored in the main memory and serves as a new long-in unlocking identification information, and the first input device is permitted to input an alarm deactivating information which is stored in the main memory and which serves as a log-in alarm deactivating information. If the hardware identification information does not match with the log-in hardware identification information, the unlocking identification information inputted through the identification information log-in device is not stored in the main memory, and the alarm deactivating information inputted through the first input device is not stored in the main memory.

In still another example, the door access control system further includes a door having an inner side and an outer side opposite to the inner side. The manual setting device and the first input device are mounted to the outer side of the door, and the identification information log-in device is mounted to the inner side of the door. When the latch is in the latching position, the door is not permitted to move from a closed position to an open position. When the latch is in the unlatching position, the door is permitted to move from the closed position to the open position.

In yet another example, the door access control system further includes a first unlatching member operatively connected to the latch driving device and a second unlatching member operatively connected to the latch driving device. When the locking mechanism is set to be in the locking state, the first unlatching member and the second unlatching member are not permitted to actuate the latch driving device to move the latch from the latching position to the unlatching position. When the locking mechanism is set to be in the unlocked state, the first unlatching member and the second unlatching member are permitted to actuate the latch driving device to move the latch from the latching position to the unlatching position.

In still another example, the door access control system further includes a door having an inner side and an outer side opposite to the inner side. The manual setting device, the first input device, and the first unlatching member are mounted to the outer side of the door. The second unlatching member is mounted to the inner side of the door. When the latch is in the latching position, the door is not permitted to move from a closed position to an open position. When the latch is in the unlatching position, the door is permitted to move from the closed position to the open position.

In a second aspect, a door access control system includes a lock having a lock control unit and a latch movable between a latching position and an unlatching position. The lock further includes an alarm device, a first input device, a main memory, and an electric setting device. Each of the alarm device, the first input device, the main memory, and the electric setting device is electrically connected to the lock control unit. The electric setting device is operable by the lock control unit to set the lock to be in a locking state or an unlocked state. A log-in unlocking identification information and a log-in alarm deactivating information are stored in the main memory. The lock further includes a manual setting device operable to set the lock to be in the locking state or the unlocked state. An unlocking device includes a second input device and a second transmission module connectable with the first transmission module.

When the lock is set to be in the locked state, the latch is not permitted to move from the latching position to the unlatching position. When the lock is set to be in the unlocked state, the latch is permitted to move from the latching position to the unlatching position.

When the second transmission module is located within a communication range of the first transmission module, the second input device is permitted to input a real-time unlocking identification information to the lock control unit.

When the second transmission module is located outside of the communication range of the first transmission module, the second input device is not permitted to input the real-time unlocking identification information to the lock control unit.

When the real-time unlocking information identification is not received by the lock control unit, the lock control unit actuates the electric setting device to set the locking mechanism to be in the locking state.

When the real-time unlocking information identification is received by the lock control unit and the log-in unlocking identification information matches with the real-time unlocking identification information, the lock control unit actuates the electric setting device to set the lock to be in the unlocked state, and the alarm device is inoperative.

When the real-time unlocking information identification received by the lock control unit and the log-in unlocking identification information does not match with the real-time unlocking identification information, the lock control unit actuates the electric setting device to set the lock to be in the locking state, and the alarm device is permitted to operate.

When the key is coupled with the manual setting device, the key is permitted to actuate the manual setting device to set the lock to be in the locking state or the unlocked state.

When the key disengages from the manual setting device, the lock remains in the locking state.

When only the manual setting device is used to set the lock to be in the unlocked state, the lock control unit activates the alarm device to generate the alarm message.

When the alarm device is in operation, the alarm device remains operative until the real-time alarm deactivating information is inputted through the first input device.

When the alarm device is in operation and the real-time alarm deactivating information is inputted through the first input device, the lock control unit stops operation of the alarm device if the log-in alarm deactivating information in the main memory matches with the real-time alarm deactivating information. The alarm device remains operative if the log-in alarm deactivating information in the main memory does not match with the real-time alarm deactivating information.

In an example, the door access control system further includes a setting module electrically connected to the control module. The setting module is operable to set the lock control unit to be in a normal mode or an away mode. When the lock control unit is set to be in the away mode, the alarm device is permitted to operate. When the lock control unit is set to be in the normal mode, the alarm device is inoperative.

In another example, the door access control system further includes a setting module electrically connected to the lock control unit. The setting module is operable to set the lock control unit to be in a normal mode or an away mode. When the lock control unit is set to be in the away mode, the alarm device is permitted to operate. When the lock control unit is set to be in the normal mode, the alarm device is inoperative.

In a further example, the door access control system further includes a door having an inner side and an outer side opposite to the inner side. The manual setting device and the first input device are mounted to the outer side of the door. The setting module is located at an inner side of the door. When the latch is in the latching position, the door is not permitted to move from a closed position to an open position. When the latch is in the unlatching position, the door is permitted to move from the closed position to the open position.

In still another example, the door access control system further includes a reporting module electrically connected to the lock control unit. When the alarm device is in an inoperative state, the reporting module does not operate. When the alarm device is in an operative state, the reporting module reports to at least one of police, a security company, and a manager of the lock.

In yet another example, the door access control system further includes a memory electrically connected to the control module. A hardware identification information of the control module is stored in the memory. An identification information log-in device is electrically connected to the lock control unit. A log-in hardware identification information is stored in the main memory. When identification information log-in device is not used, the lock control unit does not read the hardware identification information in the memory. When the identification information log-in device is used to input an unlocking identification information, the lock control unit reads the hardware identification information in the memory. If the hardware identification information matches with the log-in hardware identification information, the lock is set to be in a log-in mode permitting the unlocking identification information inputted through the identification information log-in device to be stored in the main memory and serves as a new long-in unlocking identification information. If the hardware identification information does not match with the log-in hardware identification information, the lock is set to be in a non-log-in mode not permitting the unlocking identification information inputted through the identification information log-in device to be stored in the main memory.

In still another example, the door access control system further includes a door having an inner side and an outer side opposite to the inner side. The manual setting device and the first input device are mounted to the outer side of the door. The identification information log-in device is mounted to the inner side of the door. When the latch is in the latching position, the door is not permitted to move from a closed position to an open position. When the latch is in the unlatching position, the door is permitted to move from the closed position to the open position.

In yet another example, the door access control system further includes a first unlatching member operatively connected to the latch driving device and a second unlatching member operatively connected to the latch driving device. When the lock is set to be in the locking state, the first unlatching member and the second unlatching member are not permitted to actuate the latch driving device to move the latch from the latching position to the unlatching position. When the lock is set to be in the unlocked state, the first unlatching member and the second unlatching member are permitted to actuate the latch driving device to move the latch from the latching position to the unlatching position.

In still another example, the door access control system further includes a door having an inner side and an outer side opposite to the inner side. The manual setting device, the first input device, and the first unlatching member are mounted to the outer side of the door. The second unlatching member is mounted to the inner side of the door. When the latch is in the latching position, the door is not permitted to move from a closed position to an open position. When the latch is in the unlatching position, the door is permitted to move from the closed position to the open position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
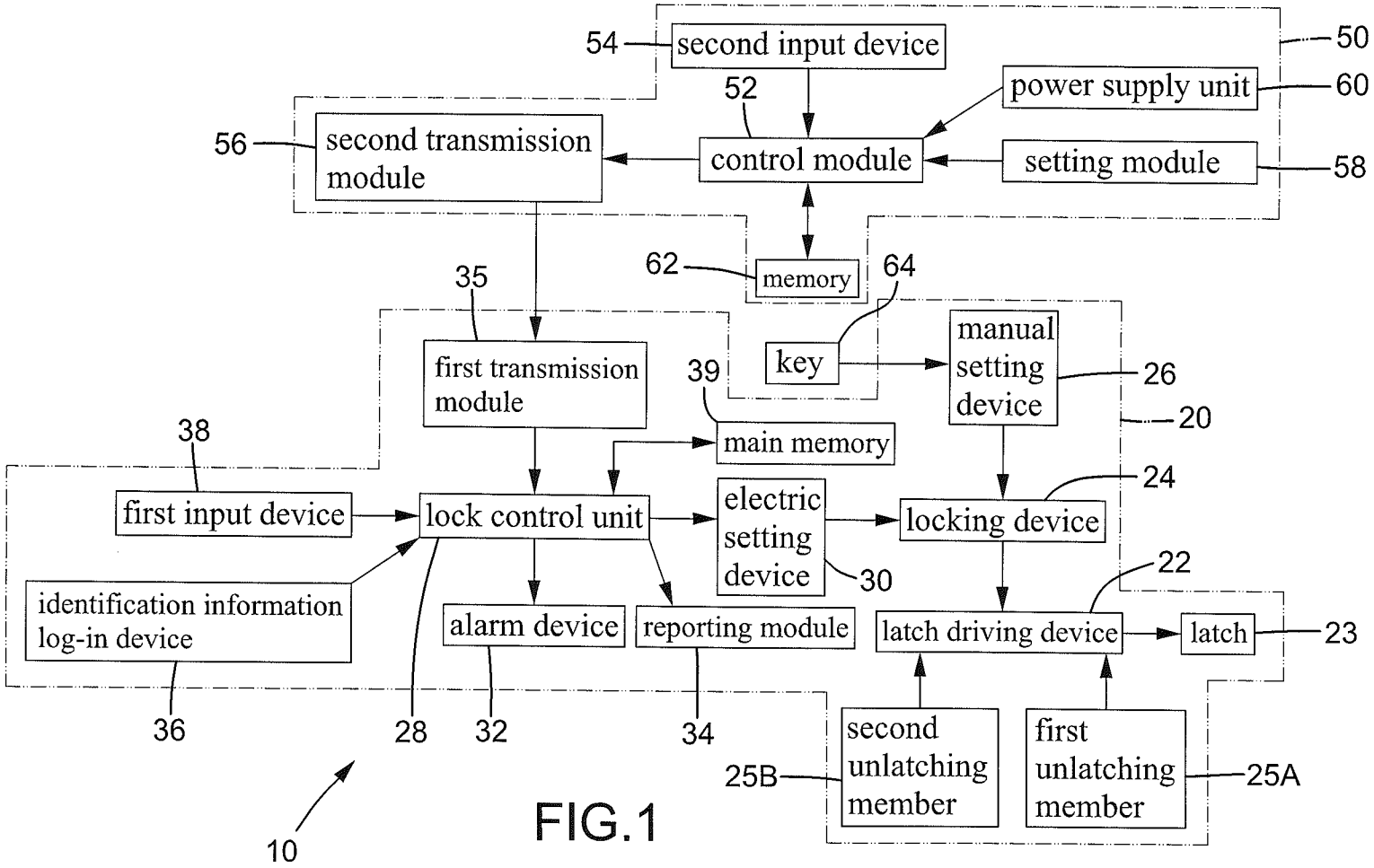
FIG. 1 is a diagrammatic block diagram of a door access control system of a first embodiment according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "side", "inner", "outer", "portion", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 2:
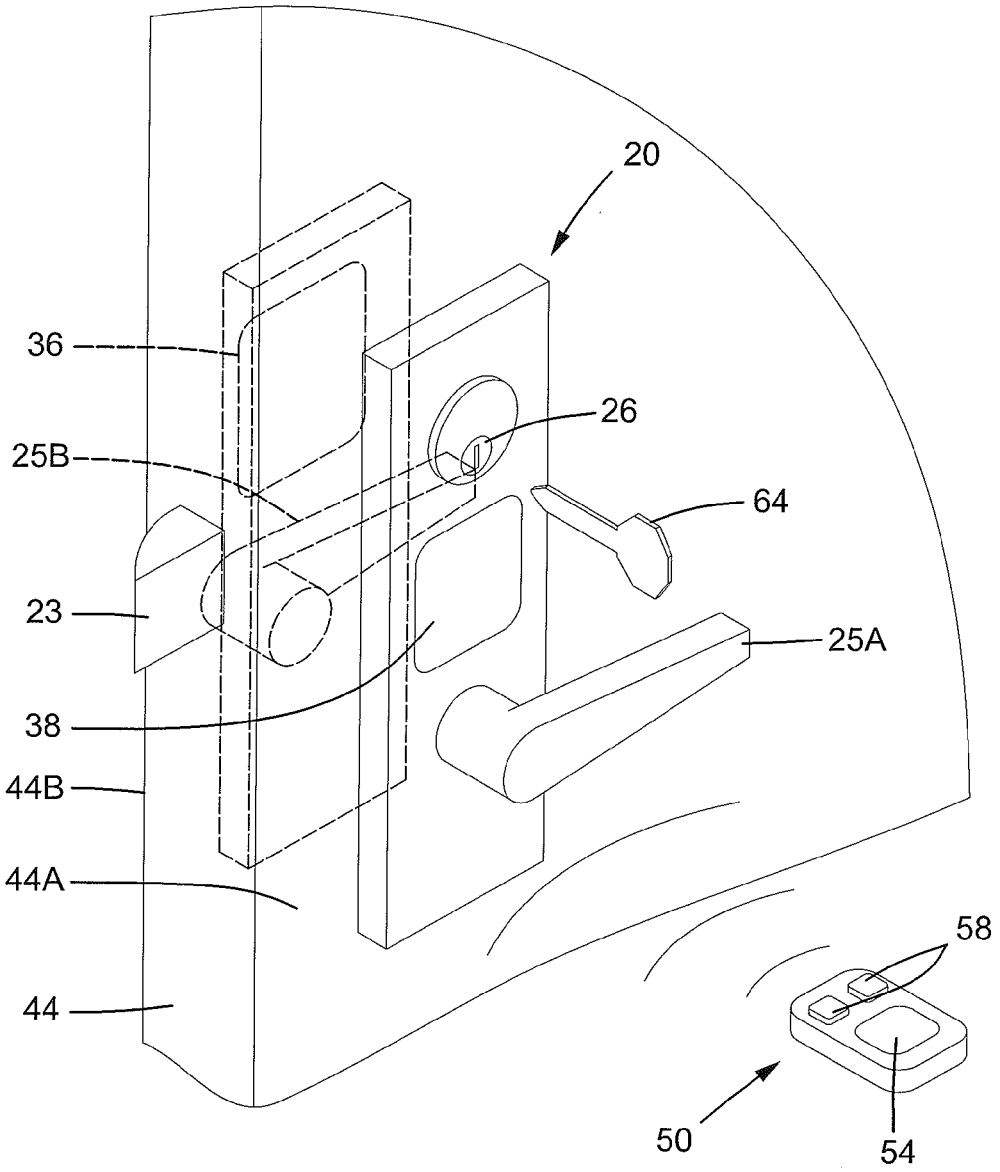
FIG. 2 is a diagrammatic perspective view of an example of the door access control system of FIG. 1, with a key separate from an unlocking device.

With reference to FIGS. 1 and 2, a door access control system 10 of a first embodiment according to the present invention includes a door 44 mounted to a passage of a space. Door 44 includes an inner side 44B facing the space and an outer side 44A opposite to inner side 44B. Door 44 is movable between a closed position closing the space and an open position permitting access to the space.

Door access control system 10 of the first embodiment further includes a lock 20 mounted to door 44. Lock 20 includes a latch driving device 22 and a latch 23 actuatable by latch driving device 22 to move between a latching position and an unlatching position. Lock 20 further includes a locking mechanism 24 for prohibiting operation of latch driving device 22. Lock 20 further includes a manual setting device 26 and an electric setting device 30. Each of manual setting device 26 and electric setting device 30 can set locking mechanism 24 to be in a locking state or an unlocked state.

Lock 20 further includes a first unlatching member 25A mounted to outer side 44A of door 44 and operatively connected to latch driving device 22. Lock 20 further includes a second unlatching member 25B mounted to inner side 44B of door 44 and operatively connected to latch driving device 22. Lock 20 further includes a lock control unit 28 electrically connected to electric setting device 30. Lock 20 further includes an alarm device 32, a reporting module 34, an identification information log-in device 36, a first transmission module 35, a first input device 38, and a main memory 39. Each of alarm device 32, reporting module 34, identification information log-in device 36, first transmission module 35, first input device 38, and main memory 39 is electrically connected to lock control unit 28. Manual setting device 26 and first input device 38 are mounted to outer side 44A of door 44. Identification information log-in device 36 is mounted to inner side 44B of door 44 and permits a user to input unlocking identification information. First input device 38 permits the user to input alarm deactivating information. Reporting module 34 can be connected to at least one of the police, a security company, and a manager of lock 20 by a local telephone system, the Internet, or a mobile network.

First transmission module 35 can use a contact type technique (such as an electrode) or a non-contact type technique (such as blue-tooth or near field communication (NFC)). Alarm device 32 can be at least one of a lighting element, a buzzer, and a speaker.

Each of identification information log-in device 36 and first input device 38 can be a keypad, a touch screen, an iris recognition device, a finger vein detection device, or a fingerprint recognition device. If a keypad is used, the unlocking identification information is a combination of numbers. If a touch screen is used, the unlocking identification information is a pin number, a figure, at least one letter, at least one number, at least one symbol, or a combination thereof. If an iris recognition device is used, the unlocking identification information is the biological features of the user. If a finger vein recognition device is used, the unlocking identification information is the finger vein biological features of the user. If a fingerprint recognition device is used, the unlocking identification information is the fingerprints of the user.

First and second manual setting devices 26 and 27 can be key cylinders of any desired form as conventional including but not limited to of a commercially available type. A key 64 can be used to relieve the locking state of manual setting device 26. Thus, locking mechanism 24 can be set to be in the locking state or the unlocked state.

Door access control system 10 of the first embodiment further includes an unlocking device 50 for matching with lock 20. Unlocking device 50 includes a control module 52, a second input device 54 electrically connected to control module 52, a second transmission module 56 electrically connected to control module 52, a setting module 58, a power supply unit 60 electrically connected to control module 52, and a memory 62 electrically connected to control module 52. Second transmission module 56 can use a technique the same as the first transmission module 35, such that first and second transmission modules 35 and 56 can connect with each other. Second input device 54 can be the same as identification information log-in device 36. Memory 62 stores a unique hardware identification information of unlocking device 50. Setting module 58 can be comprised of two buttons. Power supply unit 60 can be a cell. Power supply unit 60 supplies electricity to control module 52, second input device 54, second transmission module 56, setting module 58, and memory 62.

Figure 3:
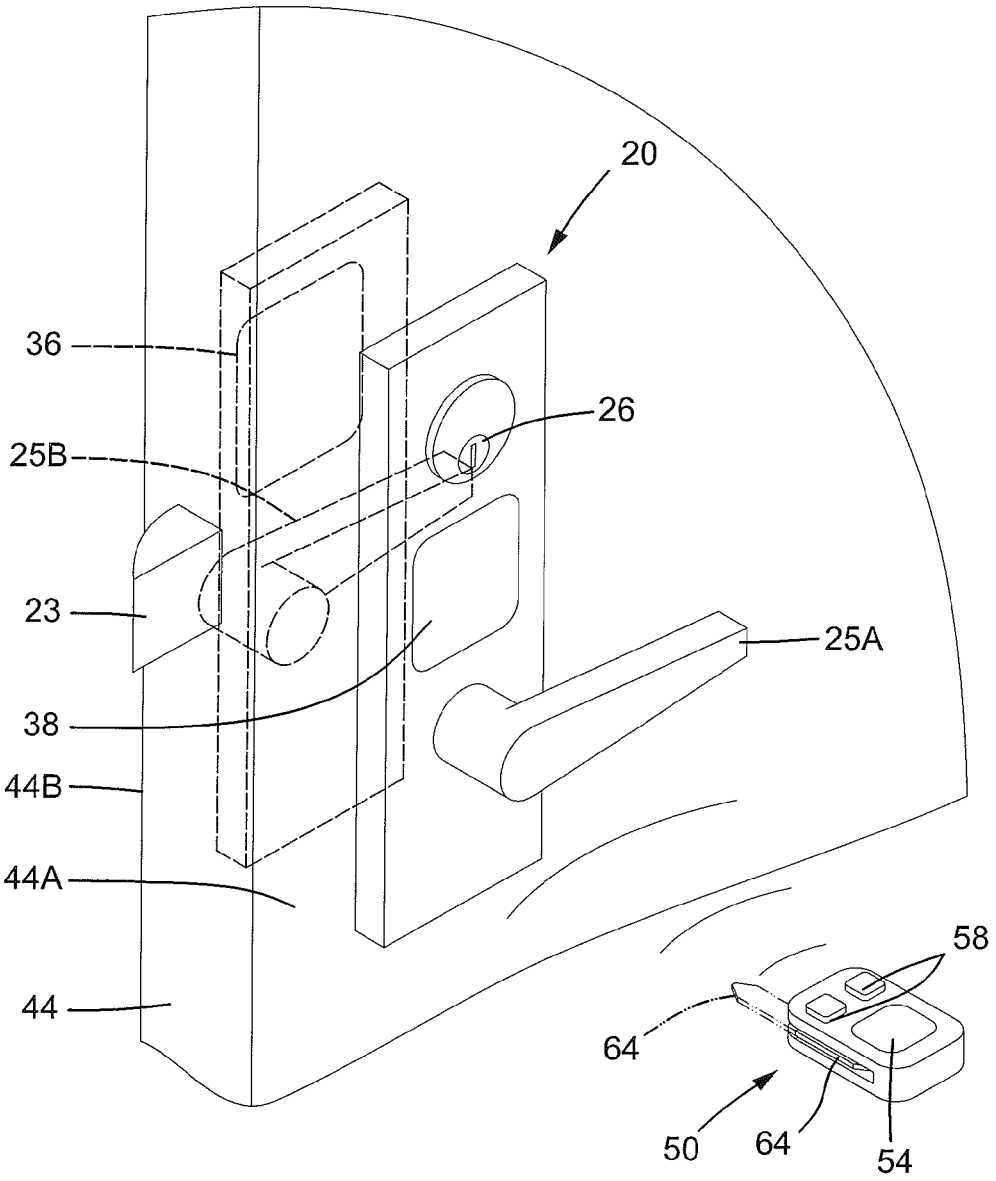
FIG. 3 is a diagrammatic perspective view of another example of the door access control system of FIG. 1, with a key disposed on an unlocking device.

Door access control system 10 of the first embodiment further includes a key 64. Key 64 can be separate from unlocking device 50 (FIG. 2) or disposed on unlocking device 50 (FIG. 3). In the example shown in FIG. 3, key 64 is pivotably mounted to unlocking device 50 and can be pivoted between a storage position inside unlocking device 50 and an operative position partially outside of unlocking device 50.

Unlocking device 50 must match with lock 20 to obtain control. When unlocking device 50 is in a communication range of first transmission module 35 of lock 20, lock 20 reads the hardware identification information in memory 62 of unlocking device 50. The hardware identification information of unlocking lock 20 in stored in main memory 39 and is used as log-in hardware identification information. Furthermore, if first and second transmission modules 35 and 56 are electrically connected by electrodes, "outside of the communication range" means first and second transmission modules 35 and 56 are disconnected, whereas "within the communication range" means first and second transmission modules 35 and 36 are electrically connected. If first and second transmission modules 35 and 56 are electrically connected by wireless connection, "outside of the communication range" means the distance between first and second transmission modules 35 and 56 is larger than the wireless signal range of the first and second transmission modules 35 and 56, and "within the communication range" means the distance between first and second transmission modules 35 and 56 is smaller than the wireless signal range of the first and second transmission modules 35 and 56.

When unlocking device 50 is in the communication range of first transmission module 35 and identification information log-in device 36 is used, lock 20 reads the hardware identification information of unlocking device 50, and lock control unit 28 compares the hardware identification information with the log-in hardware identification information in main memory 39. If the hardware identification information matches with the log-in hardware identification information in main memory 39, lock 20 is set to be in a log-in mode, permitting the unlocking identification information of the user (such as the biological features of the fingerprints, an iris, or a vein of the user) inputted through identification information log-in device 36 of lock 20 to be stored in main memory 39, thereby adding log-in unlocking identification information. A plurality of different log-in unlocking identification information can be stored. Furthermore, when lock 20 is set to be in the log-in mode, the user is permitted to use first input device 38 to input alarm deactivating information which can be stored in main memory 39, adding log-in alarm-deactivating information.

On the other hand, if lock control unit 28 identifies that the hardware identification information does not match with the log-in hardware identification information, lock 20 is set to be in a non-log-in mode not permitting operation of identification information log-in device 36 and first input device 38. Furthermore, when lock 20 is set to be in the log-in mode, a plurality of unlocking identification information of different users can be stored in main memory 39 as log-in unlocking identification information by using identification information log-in device 36. Furthermore, if identification information log-in device 36 of lock 20 is not used, lock 20 will not read the hardware identification information of unlocking device 50.

When the log-in hardware identification information of unlocking device 50 is stored in main memory 39 of lock 20, setting module 58 of unlocking device 50 can be used to set lock 20 to be in a normal mode not permitting operation of alarm device 32 and reporting module 34 or an away mode permitting operation of alarm device 32 and reporting module 34.

Now that the basic construction of door access control system 10 has been explained, the operation and some of the advantages of door access control system 10 can be set forth and appreciated. In particular, for the sake of explanation, it will be assumed that door 44 is in the closed position, latch 23 is in the latching position, and latching mechanism 24 is set to be in the locking state, such that door 4 cannot be moved from the closed position to the open position.

When at least one log-in unlocking identification information is stored in main memory 39 of lock 20, unlocking device 50 can be used to unlock lock 20 no matter whether lock 20 is set to be in the normal mode or the away mode (lock 20 is in the non-log-in mode). Specifically, when unlocking device 50 is outside of the communication range of first transmission module 35, even if second input device 54 of unlocking device 50 is used to input a real-time unlocking identification information, unlocking device 50 cannot immediately send the real-time unlocking identification information to lock 20, such that locking mechanism 24 is set to be in the locking state. Thus, latch driving device 22 cannot operate, latch 23 retains in the latching position, and door 44 cannot be opened.

When unlocking device 50 is within the communication range of first transmission module 35, second input device 54 of unlocking device 50 is used to input a real-time unlocking identification information, which is transmitted to lock 20. Lock control unit 28 compares the real-time unlocking identification information with the log-in unlocking identification information in main memory 39. If the real-time unlocking identification information does not match with the log-in unlocking identification information in main memory 39, lock control unit 28 does not actuate electric setting device 30, and locking mechanism 24 remains in the locking state, not permitting movement of latch 23 from the latching position to the unlatching position. On the other hand, if the real-time unlocking identification information matches with the log-in unlocking identification information in main memory 39, lock control unit 28 actuates electric setting device 30, and locking mechanism 24 is changed from the locking state to the unlocked state, permitting use of first unlatching member 25A or second unlatching member 25B to actuate latch driving device 22 for moving latch 23 from the latching position to the unlatching position, thereby permitting opening of door 44.

Note that no matter whether lock 20 is set to be in the normal mode or the away mode, second input device 54 of unlocking device 50 can be used to input the real-time unlocking identification information to unlock lock 20 without causing lock control unit 28 to activate alarm device 32 and reporting module 34.

Since second input device 54 and second transmission module 56 can operate only when sufficient electricity is supplied from power supply unit 60 to unlocking device 50, in a case that power supply unit 60 provides insufficient electricity for unlocking lock 20, key 64 can be used to mechanically operate manual setting device 26 for changing locking mechanism 24 from the locking state into the unlocked state. Namely, manual setting device 26 cannot be operated without key 64. Thus, if key 64 is inserted into manual setting device 26 and operated to unlock manual setting device 26, manual setting device 26 can be manually rotated by using key 64 and can be changed from the locking state to the unlocked state.

To avoid the drawback of easy compromise of a mechanical unlocking mechanism, when manual setting device 26 is used to set locking mechanism 24 to be in the unlocked state, lock control unit 28 activates alarm device 32 to generate an alarm message if lock 20 is in the away mode. Furthermore, when lock 20 is in the away mode, lock control unit 28 can use reporting module 34 to report to at least one of the police, a security company, or a manager of lock 20. When alarm device 32 and reporting module 34 are in operation, the user is permitted to use first input device 38 on outer side 44A of door 44 to input a real-time alarm deactivating information. In this case, lock control unit 28 stops operation of alarm device 32 and uses reporting module 34 to cancel the report to the at least one of the police, the security company, or the manager of lock 20. If lock control unit 28 identifies that the real-time alarm deactivating information does not match with the log-in alarm deactivating information, lock control unit 28 keeps alarm device 32 and reporting module 34 running.

When manual setting device 26 is used to set locking mechanism 24 to be in the unlocked state, if lock 20 is set to be in the normal mode, alarm device 32 and reporting module 34 will not operate. Thus, alarm device 32 and reporting module 34 will not operate even if locking mechanism 24 is set by manual setting device 26 to be in the unlocked state.

Figure 4:
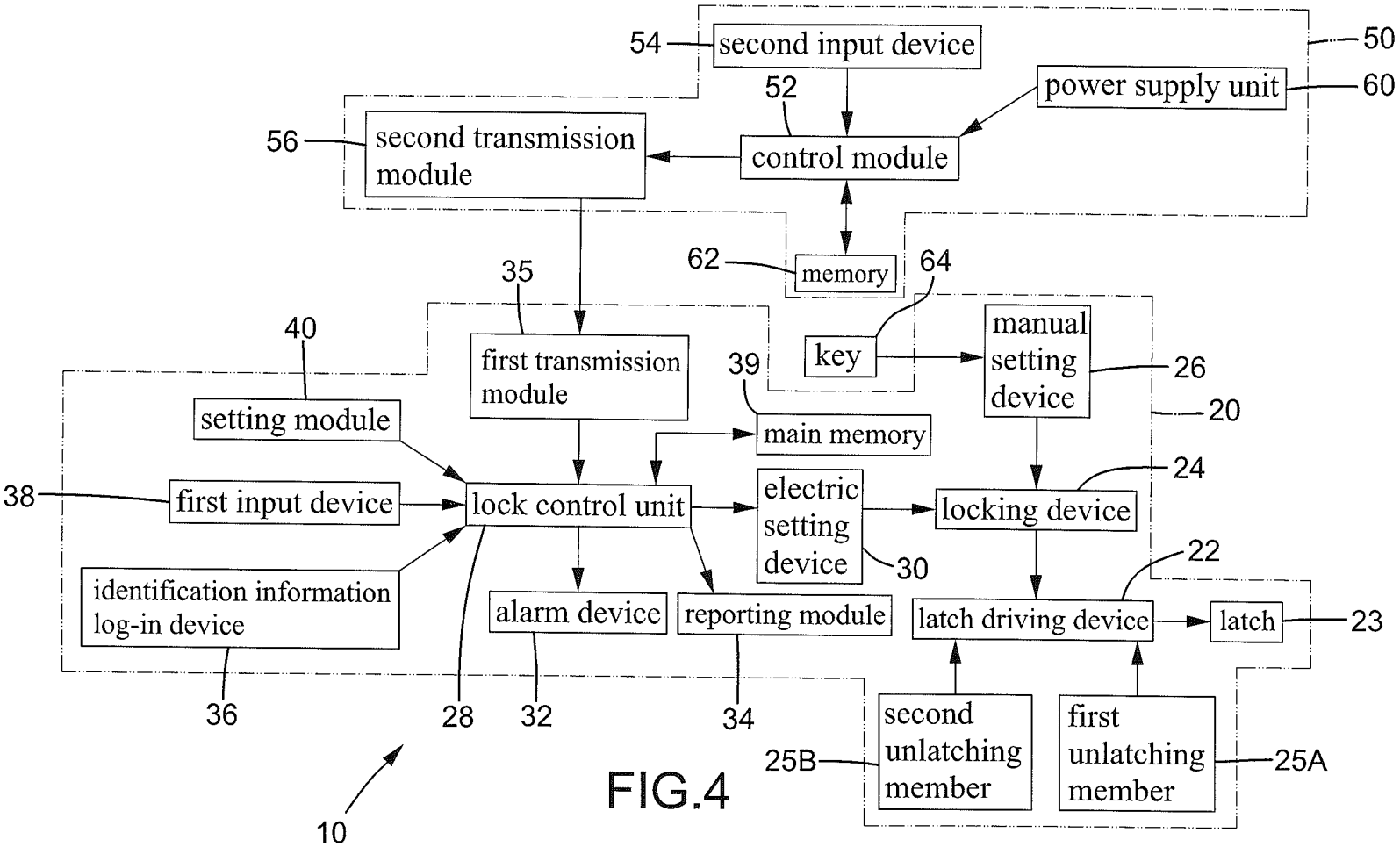
FIG. 4 is a diagrammatic block diagram of a door access control system of a second embodiment according to the present invention.
Figure 5:
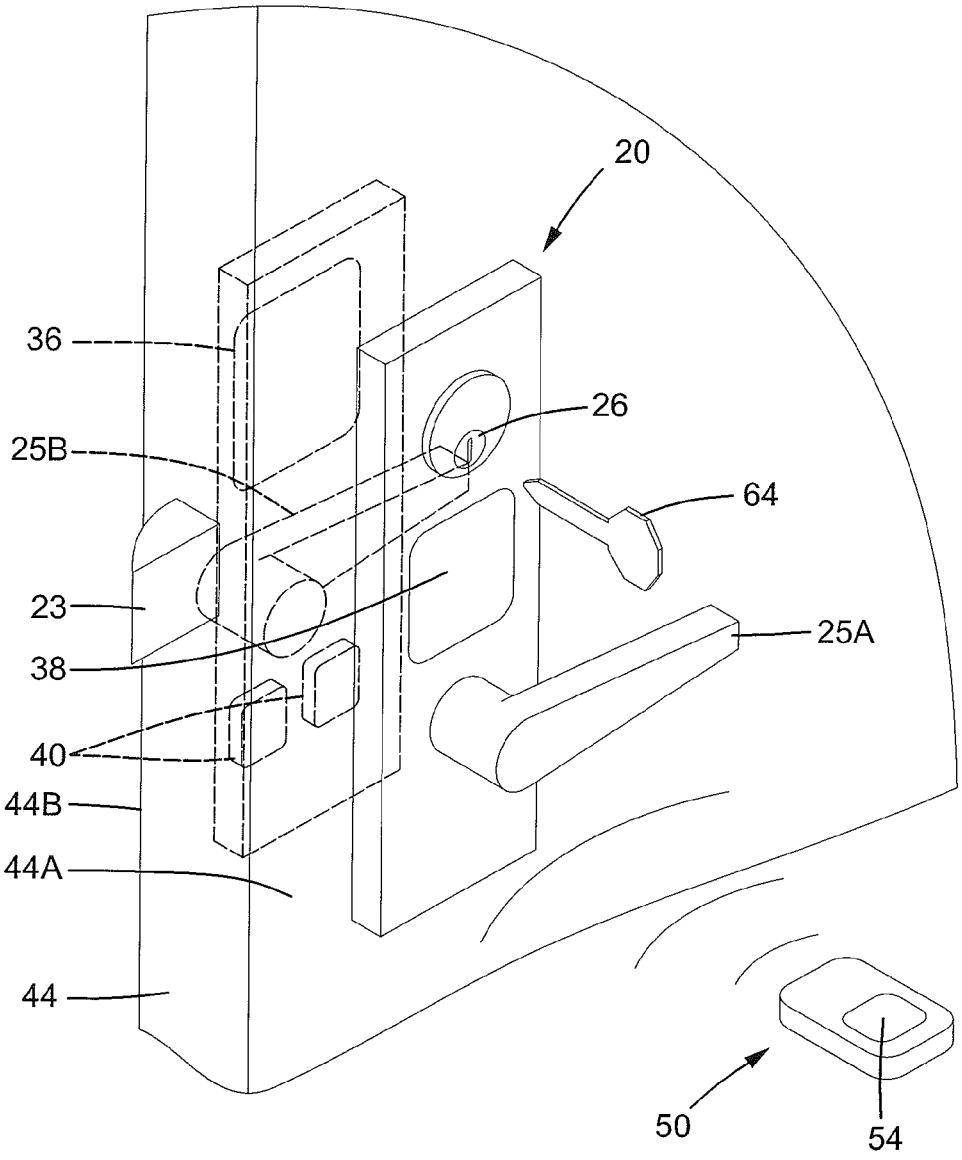
FIG. 5 is a diagrammatic perspective view of the door access control system of FIG. 4.

FIGS. 4 and 5 show a door access control system 10 of a second embodiment. In this embodiment, unlocking device 50 does not include setting module 58, and lock 20 includes a setting module 40 mounted to inner side 44B of door 44. Thus, the user can directly set lock 20 to be in the normal mode or the away mode from an inner side of door 44.

Door access control system 10 permits use of unlocking device 50 to electronically release the locking state of lock 20 and permits use of key 64 to mechanically release the locking state of lock 20. Nevertheless, after using key 64 to mechanically release the locking state of lock 20, first input device 38 of lock 20 must be used to input a real-time alarm deactivating information to stop operation of alarm device 32 and reporting module 34. Thus, door access control system 10 provides not only an excellent anti-burglar effect but provides convenient use.

Setting module 40 or setting module 58 can be used to set lock 20 to be in the normal mode in which alarm device 32 and reporting module 34 are not operative or the away mode in which alarm device 32 and reporting module 34 are operative. Thus, when lock 20 is set to be in the normal mode in which nobody moves to the outside of door 44, even if key 64 is used to release the locking state of lock 20, no alarm will be activated. When the user is about to go out, lock 20 can be set to be in the away mode to increase the anti-burglar effect of lock 20.

Now that the basic teachings of the present invention have been explained, many extensions and variations will be obvious to one having ordinary skill in the art. For example, lock 20 does not have to include reporting module 34. In this case, when lock 20 is set to be in the away mode and key 64 is used to release the locking state of lock 20, alarm device 32 operates and generates an alarm message. Furthermore, door access control system 10 can be used in other fields, such as a door of a vehicle.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A door access control system comprising:

a lock comprising:

a lock control unit;

an electric setting device electrically connected to the lock control unit;

a locking mechanism electrically connected to the electric setting device, with the electric setting device operable to set the locking mechanism to be in a locking state or an unlocked state;

a latch driving device connected to the locking mechanism;

a latch operatively connected to the latch driving device, with the latch driving device configured to move the latch between a latching position and an unlatching position, wherein when the locking mechanism is set to be in the locked state, the locking mechanism is not permitted to move the latch from the latching position to the unlatching position, and wherein when the locking mechanism is set to be in the unlocked state, the locking mechanism is permitted to move the latch from the latching position to the unlatching position, a manual setting device connected to the locking mechanism, with the manual setting device configured to set the locking mechanism to be in the locking state or the unlocked state;

a first input device electrically connected to the lock control unit, with the first input device operable to input a real-time alarm deactivating information to the lock control unit;

a main memory electrically connected to the lock control unit, wherein a log-in alarm deactivating information and a log-in unlocking identification information are stored in the main memory;

a first transmission module electrically connected to the lock control unit;

an alarm device electrically connected to the lock control unit, with the lock control unit operable not to activate the alarm device or to activate the alarm device to generate an alarm message;

an unlocking device comprising:

a control module;

a second transmission module electrically connected to the control module, with the first and second transmission modules being connectable to each other;

a second input device electrically connected to the control module, with the second input device operable to input a real-time unlocking identification information;

a power supply unit electrically connected to the control module, with the power supply unit adapted to supply electricity to the control module for operation; and a key electively coupled to the manual setting device, with the second input device located within a communication range of the first transmission module, the second input device is permitted to input a real-time unlocking information identification information to the lock control unit, with the second input device located outside of a communication range of the first transmission module, the second input device is not permitted to input the real-time unlocking information identification information to the lock control unit, with the real-time unlocking information identification not received by the lock control unit, the lock control unit actuates the electric setting device to set the locking mechanism to be in the locking state, with the real-time unlocking information identification received by the lock control unit and with the log-in unlocking identification information matched with the real-time unlocking identification information, the lock control unit actuates the electric setting device to set the locking mechanism to be in the unlocked state, and the alarm device is inoperative, with the real-time unlocking information identification received by the lock control unit and with the log-in unlocking identification information not matched with the real-time unlocking identification information, the lock control unit actuates the electric setting device to set the locking mechanism to be in the locking state, and the alarm device is permitted to operate, with the key coupled with the manual setting device, the key is permitted to actuate the manual setting device to set the locking mechanism to be in the locking state or the unlocked state, with the key disengaged from the manual setting device, the locking mechanism remains in the locking state, with the manual setting device used to set the locking mechanism to be in the unlocked state, the lock control unit activates the alarm device to generate the alarm message, with the alarm device in operation, the alarm device remains operative until the real-time alarm deactivating information is inputted through the first input device, with the alarm device in operation and with the real-time alarm deactivating information inputted through the first input device, the lock control unit stops operation of the alarm device when the log-in alarm deactivating information in the main memory matches with the real-time alarm deactivating information, and the alarm device remains operative when the log-in alarm deactivating information in the main memory does not match with the real-time alarm deactivating information.

2. The door access control system as claimed in claim 1, with the unlocking device further comprising:

a setting module electrically connected to the control module, with the setting module operable to set the lock control unit to be in a normal mode or an away mode, wherein when the lock control unit is set to be in the away mode, the alarm device is permitted to operate, and wherein when the lock control unit is set to be in the normal mode, the alarm device is inoperative.

3. The door access control system as claimed in claim 1, with the lock further comprising:

a setting module electrically connected to the lock control unit, with the setting module operable to set the lock control unit to be in a normal mode or an away mode, wherein when the lock control unit is set to be in the away mode, the alarm device is permitted to operate, and wherein when the lock control unit is set to be in the normal mode, the alarm device is inoperative.

4. The door access control system as claimed in claim 3, further comprising:

a door including an inner side and an outer side opposite to the inner side, with the manual setting device and the first input device mounted to the outer side of the door, and with the setting module located at an inner side of the door, with the latch in the latching position, the door is not permitted to move from a closed position to an open position, and with the latch in the unlatching position, the door is permitted to move from the closed position to the open position.

5. The door access control system as claimed in claim 1, with the lock further comprising:

a reporting module electrically connected to the lock control unit, with the alarm device in an inoperative state, the reporting module does not operate, and with the alarm device in an operative state, the reporting module reports to at least one of police, a security company, and a manager of the lock.

6. The door access control system as claimed in claim 1, with the unlocking device further comprising:

a memory electrically connected to the control module, with a hardware identification information of the control module stored in the memory; and an identification information log-in device electrically connected to the lock control unit, wherein a log-in hardware identification information is stored in the main memory, with the identification information log-in device not used, the lock control unit does not read the hardware identification information in the memory, with the identification information log-in device used to input an unlocking identification information, the lock control unit reads the hardware identification information in the memory, wherein when the hardware identification information matches with the log-in hardware identification information, the unlocking identification information inputted through the identification information log-in device is stored in the main memory and serves as a new long-in unlocking identification information, and the first input device is permitted to input an alarm deactivating information which is stored in the main memory and which serves as a log-in alarm deactivating information, and wherein when the hardware identification information does not match with the log-in hardware identification information, the unlocking identification information inputted through the identification information log-in device is not stored in the main memory, and the alarm deactivating information inputted through the first input device is not stored in the main memory.

7. The door access control system as claimed in claim 6, further comprising:

a door including an inner side and an outer side opposite to the inner side, with the manual setting device and the first input device mounted to the outer side of the door, and with the identification information log-in device mounted to the inner side of the door, with the latch in the latching position, the door is not permitted to move from a closed position to an open position, and with the latch in the unlatching position, the door is permitted to move from the closed position to the open position.

8. The door access control system as claimed in claim 1, with the lock further comprising:

a first unlatching member operatively connected to the latch driving device; and a second unlatching member operatively connected to the latch driving device, with the locking mechanism set to be in the locking state, the first unlatching member and the second unlatching member are not permitted to actuate the latch driving device to move the latch from the latching position to the unlatching position, and with the locking mechanism set to be in the unlocked state, the first unlatching member and the second unlatching member are permitted to actuate the latch driving device to move the latch from the latching position to the unlatching position.

9. The door access control system as claimed in claim 8, further comprising:

a door including an inner side and an outer side opposite to the inner side, with the manual setting device, the first input device, and the first unlatching member mounted to the outer side of the door, and with the second unlatching member mounted to the inner side of the door, with the latch in the latching position, the door is not permitted to move from a closed position to an open position, and with the latch in the unlatching position, the door is permitted to move from the closed position to the open position.

10. A door access control system comprising:

a lock including a lock control unit and a latch movable between a latching position and an unlatching position, with the lock further including an alarm device, a first input device, a main memory, and an electric setting device, with each of the alarm device, the first input device, the main memory, and the electric setting device being electrically connected to the lock control unit, with the electric setting device operable by the lock control unit to set the lock to be in a locking state or an unlocked state, with a log-in unlocking identification information and a log-in alarm deactivating information stored in the main memory, with the lock further including a manual setting device operable to set the lock to be in the locking state or the unlocked state; and an unlocking device including a second input device and a second transmission module connectable with the first transmission module;

with the lock set to be in the locked state, the latch is not permitted to move from the latching position to the unlatching position, with the lock set to be in the unlocked state, the latch is permitted to move from the latching position to the unlatching position, with the second transmission module located within a communication range of the first transmission module, the second input device is permitted to input a real-time unlocking identification information to the lock control unit, with the second transmission module located outside of the communication range of the first transmission module, the second input device is not permitted to input the real-time unlocking identification information to the lock control unit, with the real-time unlocking information identification not received by the lock control unit, the lock control unit actuates the electric setting device to set the locking mechanism to be in the locking state, with the real-time unlocking information identification received by the lock control unit and with the log-in unlocking identification information matched with the real-time unlocking identification information, the lock control unit actuates the electric setting device to set the lock to be in the unlocked state, and the alarm device is inoperative, with the real-time unlocking information identification received by the lock control unit and with the log-in unlocking identification information not matched with the real-time unlocking identification information, the lock control unit actuates the electric setting device to set the lock to be in the locking state, and the alarm device is permitted to operate, with a key coupled with the manual setting device, the key is permitted to actuate the manual setting device to set the lock to be in the locking state or the unlocked state, with the key disengaged from the manual setting device, the lock remains in the locking state, wherein when only the manual setting device is used to set the lock to be in the unlocked state, the lock control unit activates the alarm device to generate the alarm message, with the alarm device in operation, the alarm device remains operative until the real-time alarm deactivating information is inputted through the first input device, with the alarm device in operation and with the real-time alarm deactivating information inputted through the first input device, the lock control unit stops operation of the alarm device when the log-in alarm deactivating information in the main memory matches with the real-time alarm deactivating information, and the alarm device remains operative when the log-in alarm deactivating information in the main memory does not match with the real-time alarm deactivating information.

11. The door access control system as claimed in claim 10, with the unlocking device further comprising:

a setting module electrically connected to a control module, with the setting module operable to set the lock control unit to be in a normal mode or an away mode, wherein when the lock control unit is set to be in the away mode, the alarm device is permitted to operate, and wherein when the lock control unit is set to be in the normal mode, the alarm device is inoperative.

12. The door access control system as claimed in claim 10, with the lock further comprising:

a setting module electrically connected to the lock control unit, with the setting module operable to set the lock control unit to be in a normal mode or an away mode, wherein when the lock control unit is set to be in the away mode, the alarm device is permitted to operate, and wherein when the lock control unit is set to be in the normal mode, the alarm device is inoperative.

13. The door access control system as claimed in claim 12, further comprising:

a door including an inner side and an outer side opposite to the inner side, with the manual setting device and the first input device mounted to the outer side of the door, and with the setting module located at an inner side of the door, with the latch in the latching position, the door is not permitted to move from a closed position to an open position, and with the latch in the unlatching position, the door is permitted to move from the closed position to the open position.

14. The door access control system as claimed in claim 10, with the lock further comprising:

a reporting module electrically connected to the lock control unit, with the alarm device in an inoperative state, the reporting module does not operate, and with the alarm device in an operative state, the reporting module reports to at least one of police, a security company, and a manager of the lock.

15. The door access control system as claimed in claim 10, with the unlatching device further comprising:

a memory electrically connected to a control module, with a hardware identification information of the control module stored in the memory; and an identification information log-in device electrically connected to the lock control unit, wherein a log-in hardware identification information is stored in the main memory, with the identification information log-in device not used, the lock control unit does not read the hardware identification information in the memory, with the identification information log-in device used to input an unlocking identification information, the lock control unit reads the hardware identification information in the memory, wherein when the hardware identification information matches with the log-in hardware identification information, the lock is set to be in a log-in mode permitting the unlocking identification information inputted through the identification information log-in device to be stored in the main memory and serves as a new long-in unlocking identification information, and wherein when the hardware identification information does not match with the log-in hardware identification information, the lock is set to be in a non-log-in mode not permitting the unlocking identification information inputted through the identification information log-in device to be stored in the main memory.

16. The door access control system as claimed in claim 15, further comprising:

a door including an inner side and an outer side opposite to the inner side, with the manual setting device and the first input device mounted to the outer side of the door, and with the identification information log-in device mounted to the inner side of the door, with the latch in the latching position, the door is not permitted to move from a closed position to an open position, and with the latch in the unlatching position, the door is permitted to move from the closed position to the open position.

17. The door access control system as claimed in claim 10, with the lock further comprising:

a first unlatching member operatively connected to the latch driving device; and a second unlatching member operatively connected to the latch driving device, with the lock set to be in the locking state, the first unlatching member and the second unlatching member are not permitted to actuate the latch driving device to move the latch from the latching position to the unlatching position, and with the lock set to be in the unlocked state, the first unlatching member and the second unlatching member are permitted to actuate the latch driving device to move the latch from the latching position to the unlatching position.

18. The door access control system as claimed in claim 17, further comprising:

a door including an inner side and an outer side opposite to the inner side, with the manual setting device, the first input device, and the first unlatching member mounted to the outer side of the door, and with the second unlatching member mounted to the inner side of the door, with the latch in the latching position, the door is not permitted to move from a closed position to an open position, and with the latch in the unlatching position, the door is permitted to move from the closed position to the open position.

* * * * *